United States Patent [19]

Troffkin

[11] 3,975,166

[45] Aug. 17, 1976

[54] GELLED ACRYLIC POLYMER

[75] Inventor: Howard Julian Troffkin, Arlington, Va.

[73] Assignee: The United States of America as represented by the Secretary of the Army, Washington, D.C.

[22] Filed: Dec. 23, 1966

[21] Appl. No.: 605,148

[52] U.S. Cl. ..... 44/7 D; 252/316

[51] Int. Cl.[2] ..... C10L 7/02

[58] Field of Search ..... 149/18, 19; 260/29.6 AN, 29.6 EM, 89.5 A, 89.5 S; 252/316; 44/7, 7 D

[56] References Cited

UNITED STATES PATENTS 3,322,583 5/1967 Guthrie et al. ..... 149/19

*Primary Examiner*—Leland A. Sebastian

*Attorney, Agent, or Firm*—Nathan Edelberg; Robert W. Church

[57] ABSTRACT

The invention is a composition of matter comprising acrylonitrile, an acrylic polymer containing a nitrile group and isopropyl dicyanamide or 1,1-dimethyl-2,2-dicyanohydrazine gelling agent, useful as fuel gels.

5 Claims, No Drawings

GELLED ACRYLIC POLYMER

The invention relates to novel compositions of matter. More particularly, this invention relates to gellable and gelled compositions of matter composed of acrylonitrile, a nitrile group-containing, acrylonitrile-soluble polymer and a dicyanamide derivative gelling agent.

The gelling of gasoline for purposes of preparing compositions which may be used in aerial and ground warfare has been known for many years. Among the materials which have been used to gel gasoline to produce such compositions are the sodium and aluminum salts of various carboxylic acids such as caprylic acid, palmitic acid, naphthenic acid and the like. The resultant compositions, more familiarly known as napalm thickened gasoline, or simply "napalm", possess excellent flaming ability but suffer from many drawbacks. Two of the more serious shortcomings of napalm are instability on storage and affinity for water. That is to say, the napalm gasoline gel is very unstable and therefore must be prepared near the site of its ultimate use and used within a relatively short period of time thereafter. Also the gelling properties of napalm are affected by moisture to the extent that relatively water-free conditions must prevail during its preparation.

I have now found a novel group of compositions which may be prepared prior to their ultimate use and safely stored for long periods of time without decomposing. Additionally, my compositions may be prepared under normal, every-day atmospheric conditions without fear of undesired reactions and by-products. My compositions are hydrolytically stable and, even more importantly, may be charged into munition casings, e.g. hand grenades, bombs, etc. before gelling. A further advantage of my composition is that they transfer more heat to a target than known systems.

As mentioned above, my compositions are composed of three components.

The first component is acrylonitrile which may be present in amounts ranging from about 25% to about 75%, by weight, preferably about 50% to about 70%, by weight, based on the total weight of the ultimate composition.

The second component is an acrylonitrile-soluble, nitrile group-containing polymer. Any polymer which is soluble in acrylonitrile and possess a plurality of reactive nitrile groups may be used. One polymer found reasonably efficient is a terpolymer of from about 50% to about 90% of acrylonitrile, from about 10% to about 50% of methyl methacrylate and from about 5% to about 15% of acrylic acid. The polymer may be used in my flame compositions in amounts ranging from about 1.5% to about 15.0%, preferably about 2.0% to about 10.0%, by weight, based on the the total weight of the ultimate composition. Although not a critical feature, I have found that terpolymers having intrinsic viscosities ranging from about 2.0 to 5.0 dl./g are reasonably effective. These polymers are known in the art and can be prepared by contacting the monomers with a freeradical generating catalyst under elevated temperatures.

The third component in my novel composition is a dicyanamide derivative gelling agent. Examples of materials which may be used include isopropyl dicyanamide, 1,1-dimethyl-2,2-dicyanohydrazine and the like. The gelling agents should be used in amounts ranging from about 25% to about 75%, by weight, based on the total weight of the ultimate composition. The additive percentages of the three components of my novel compositions should, of course, total 100%.

My novel compositions may be prepared by dissolving the appropriate amount of the acrylonitrile-soluble polymer in the acrylonitrile. The gelling agent is then added with stirring. The resulting solution gells very rapidly.

My novel compositions are fuel gels or flame agents which function over a wide spectrum of flame weapon applications such as flame-throwers, shells, grenades and the like.

The following examples are set forth for purposes of illustration only and are not to be construed as limitations on the instant invention. All parts and percentages are by weight unless otherwise specified.

EXAMPLE 1

To a suitable reaction vessel are added 20 parts of acrylonitrile and 2 parts of a terpolymer of methyl methacrylate, acrylonitrile and acrylic acid (50/45/5). To the resultant solution are added 20 parts of isopropyl dicyanamide. The resultant solution gels in about 5 minutes. The resultant gel burns when ignited.

EXAMPLE 2

Following the procedure of Example 1 except that 1,1-dimethyl-2,2-dicyanohydrazine is substituted for the isopropyl dicyanamide, a gelled composition which burns when ignited is recovered.

I claim:

1. A composition of matter comprising (A) from about 25% to about 75% of acrylonitrile, (B) from about 1.5% to about 15% of an acrylonitrile-soluble, nitrile group-containing acrylic polymer having an intrinsic viscosity ranging from about 2.0 to about 5.0 dl./g and (C) from 25% to about 75%, of a liquid dicyanamide derivative gelling agent selected from the group consisting of isopropyl dicyanamide and 1,1-dimethyl-2,2-dicyanohydrazine, said percentages being by weight based on the total weight of the ultimate composition.

2. A composition according to claim 1 wherein (B) is a terpolymer of acrylonitrile, methyl methacrylate and acrylic acid.

3. A composition according to claim 1 wherein (C) is isopropyl dicyanamide.

4. A composition according to claim 1 wherein (C) is 1,1-dimethyl-2,2-dicyano-hydrazine.

5. A composition according to claim 1 wherein (B) is a terpolymer of acrylonitrile, methyl methacrylate and acrylic acid and (C) is a isopropyl dicyanamide.

* * * * *